US006830106B2

(12) United States Patent
Cavender

(10) Patent No.: US 6,830,106 B2
(45) Date of Patent: Dec. 14, 2004

(54) MULTILATERAL WELL COMPLETION APPARATUS AND METHODS OF USE

(75) Inventor: Travis W. Cavender, Angleton, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 33 days.

(21) Appl. No.: 10/226,360

(22) Filed: Aug. 22, 2002

(65) Prior Publication Data

US 2004/0035581 A1 Feb. 26, 2004

(51) Int. Cl.[7] ..... E21B 7/08; E21B 7/06; E21B 43/14

(52) U.S. Cl. ..... 166/313; 166/50; 166/117.5; 166/241.6

(58) Field of Search ..... 166/313, 50, 117.5, 166/117.6, 241.6

(56) References Cited

U.S. PATENT DOCUMENTS

| | | | | |
|---|---|---|---|---|
| 2,452,920 A | | 11/1948 | Gilbert | |
| 5,458,209 A | | 10/1995 | Hayes et al. | |
| 5,564,503 A | * | 10/1996 | Longbottom et al. | 166/313 |
| 5,615,740 A | | 4/1997 | Comeau et al. | |
| 5,813,465 A | * | 9/1998 | Terrell et al. | 166/50 |
| 5,862,862 A | | 1/1999 | Terrell | |
| 5,941,308 A | * | 8/1999 | Malone et al. | 166/313 |
| 6,089,320 A | | 7/2000 | LaGrange | |
| 6,241,021 B1 | | 6/2001 | Bowling | |
| 6,354,375 B1 | * | 3/2002 | Dewey | 166/313 |

FOREIGN PATENT DOCUMENTS

| | | |
|---|---|---|
| FR | 2692316 | 12/1993 |
| GB | 2 345 933 A | 7/2000 |
| GB | 2 361 257 A | 10/2001 |
| GB | 2 371 579 A | 7/2002 |

OTHER PUBLICATIONS

Sperry–Sun Multilateral Services Profile, "LRW–SL™ Self–Locating Lateral Re–Entry System", dated 2000.
Sperry–Sun Multilateral Services Profile, "LRW–SL™ Self–Locating Lateral Re–Entry Whipstock", dated 2000.
Sperry–Sun Multilateral Services Profile, "LRS™ Lateral Re–Entry System", dated 2000.
Sperry–Sun Multilateral Services Profile, "Wreal™ Wireline Re–Entry Alignment System", dated 2000.
Sperry–Sun Multilateral Services Profile, "TEW™ Tubing Exit Whipstock", dated 2000.
Sperry–Sun Multilateral Services Profile, "LRW™ Lateral Re–Entry Whipstock", dated 2000.
Sperry–Sun Multilateral Services Profile, TPI™ Through–Tubing Pressure Isolation Sleeve, dated 2000.
Sperry–Sun Multilateral Services Profile, "Vector Block", dated 2000.
Sperry–Sun Multilateral Services Profile, "RDS™ Re–Entry Drilling System", dated 2000.

(List continued on next page.)

*Primary Examiner*—David Bagnell
*Assistant Examiner*—Brian D. Halford
(74) *Attorney, Agent, or Firm*—Marlin R. Smith; J. Richard Konneker

(57) ABSTRACT

A multilateral well completion. In a described embodiment, a multilateral well completion system includes a completion apparatus installed in a cased parent wellbore. The completion apparatus has an opening in its side which is rotationally aligned with a window in the parent wellbore casing. A tubular string is inserted through an inner tubular structure of the apparatus, through the opening, through the window, and into a branch wellbore extending outwardly from the window.

38 Claims, 5 Drawing Sheets

OTHER PUBLICATIONS

Sperry–Sun Multilateral Services Profile, Merlin™ Milled Exit Retrievable Multilateral System, dated 2000.
Sperry–Sun Multilateral Services Profile, "4502™/4503™ Metal Mill–Through Systems", dated 2000.
Sperry–Sun Multilateral Services Profile, "RMLS™ Retrievable Multilateral System", dated 2000.
Sperry–Sun Multilateral Services Profile, "LTBS™ Lateral Tie–Back System", dated 2000.
Sperry–Sun Multilateral Services Profile, "Pace–6™ Pressure–Actuated Casing Exit System", dated 2000.
Sperry–Sun Multilateral Services Profile, "Sperry–Sun Latch Coupling", dated 2000.
Sperry–Sun Multilateral Services Profile, "4501™ Low–Side Perforation System", dated 2000.
Sperry–Sun Multilateral Services Profile, "MSCS® Multi–String Completion System", dated 2000.
Sperry–Sun Multilateral Services Profile, "ITBS™ Isolated Tie–Back System", dated 2000.
Sperry–Sun Multilateral Services, and Solutions, dated 2000.
Pending U.S. application: 10/122,424, filed Apr. 12, 2002, entitled Sealed Multilateral Junction System.
Pending U.S. application: 10/103,381, filed Mar. 21, 2002, entitled Downhole Tubular String Connections.
Pending U.S. application: 10/103,025, filed Mar. 21, 2002, entitled Isolation Bypass Transition Joint.
Search Report for United Kingdom Application No.: GB 0319233.3.

* cited by examiner

MULTILATERAL WELL COMPLETION APPARATUS AND METHODS OF USE

BACKGROUND

The present invention relates generally to operations performed and equipment utilized in conjunction with subterranean wells and, in an embodiment described herein, more particularly provides a multilateral well completion.

Those skilled in the art know that it is very difficult to form a sealed junction between intersecting wellbores in a well. The environment is hostile and very remote from the earth's surface. For this reason, systems developed to form wellbore junctions categorized in the industry as TAML level 5 and above tend to be very sophisticated and, accordingly, very expensive.

What is needed is a multilateral well completion system which may be used to form a TAML level 5 or above wellbore junction, but which is relatively inexpensive to construct and straightforward in its installation.

SUMMARY

In carrying out the principles of the present invention, in accordance with an embodiment thereof, a multilateral well completion system is provided which satisfies the above described need in the art. Also provided are multilateral well completion apparatus and methods.

In one aspect of the invention, a multilateral well completion system is provided. A parent wellbore is lined with a casing string. A branch wellbore extends outwardly from a window in the casing string. A completion apparatus is positioned within the parent wellbore, the apparatus including inner and outer tubular structures, the outer tubular structure extending in the parent wellbore on opposite sides of the window, the outer tubular structure having an opening in a sidewall thereof aligned with the window, the inner tubular structure extending longitudinally within the outer tubular structure to the opening, and a longitudinal flow passage formed through the inner tubular structure extending through the opening.

In another aspect of the invention, a multilateral well completion apparatus is provided. The apparatus includes inner and outer tubular structures. A first portion of the inner tubular structure extends longitudinally within the outer tubular structure, thereby forming an annulus therebetween. A second portion of the inner tubular structure deviates laterally relative to the outer tubular structure, so that a longitudinal flow passage of the inner tubular structure extends outwardly through an opening formed through a sidewall of the outer tubular structure.

In yet another aspect of the invention, a method of completing a multilateral well is provided. The method includes the steps of: installing a completion apparatus in a parent wellbore having a window formed in casing lining the parent wellbore; rotationally aligning the completion apparatus relative to the window, thereby aligning an opening in a sidewall of an outer tubular structure of the apparatus with a branch wellbore extending outwardly from the window; and inserting a tubular string through an inner tubular structure of the completion apparatus, the inner tubular structure thereby directing the tubular string to deviate laterally out the opening, through the window, and into the branch wellbore.

These and other features, advantages, benefits and objects of the present invention will become apparent to one of ordinary skill in the art upon careful consideration of the detailed description of a representative embodiment of the invention hereinbelow and the accompanying drawings.

DETAILED DESCRIPTION

Figure 1:
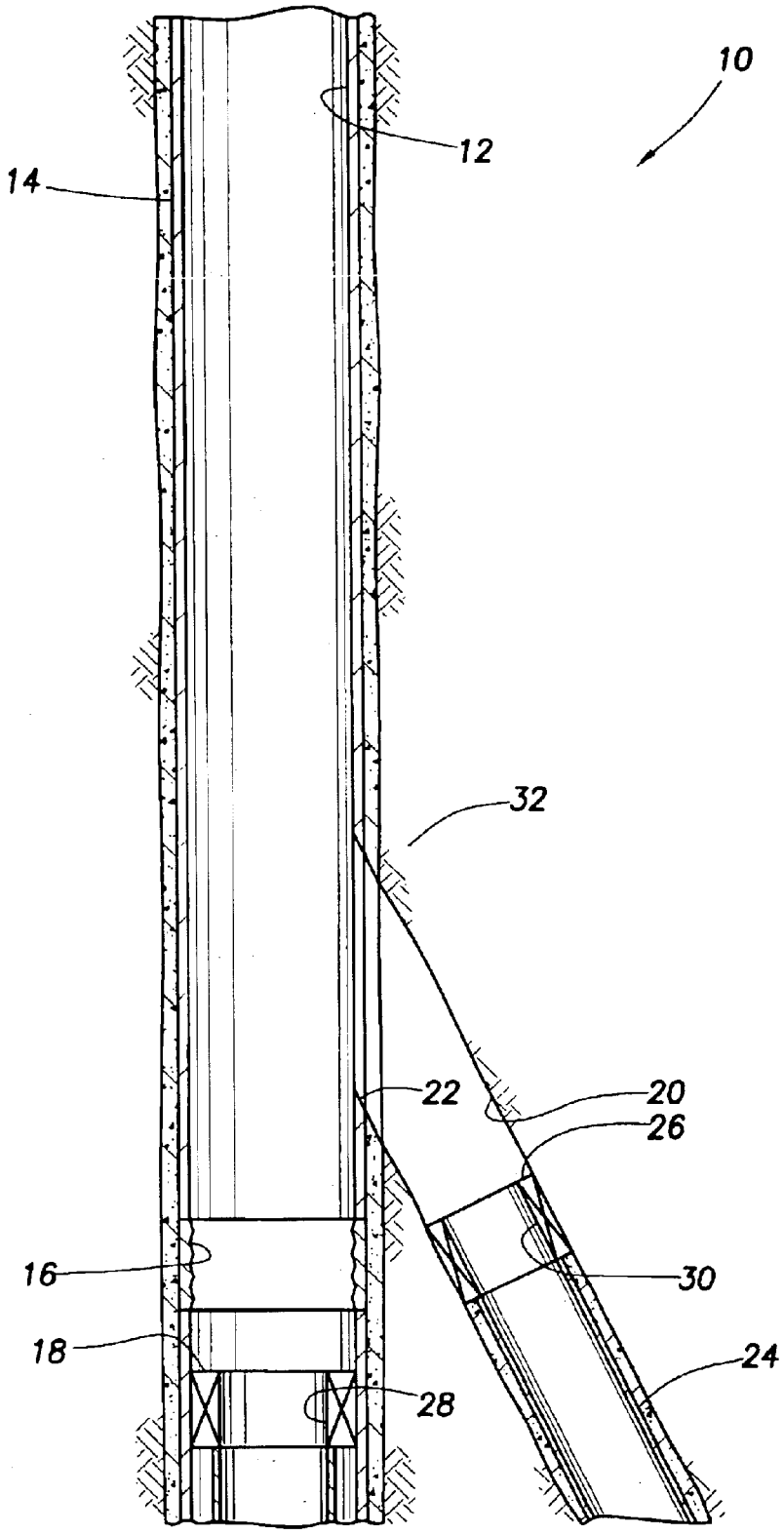
FIG. 1 is a schematic cross-sectional view illustrating initial steps in a method embodying principles of the present invention.

Representatively illustrated in FIG. 1 is a method 10 which embodies principles of the present invention. In the following description of the method 10 and other apparatus and methods described herein, directional terms, such as "above", "below", "upper", "lower", etc., are used only for convenience in referring to the accompanying drawings. Additionally, it is to be understood that the embodiment of the invention described herein may be utilized in various orientations, such as inclined, inverted, horizontal, vertical, etc., and in various configurations, without departing from the principles of the present invention.

In the method 10, a parent wellbore 12 is drilled and lined with a casing string 14. As used herein, the terms "casing string", "casing", "cased" and the like are used for convenience to refer to any wellbore linings, such as casing, liner, etc., made of any material, such as steel, other metals, plastic, composites, etc.

An orienting latch profile 16 is interconnected in the casing string 14 in the method 10 as depicted in FIG. 1. The orienting latch profile 16 is of the type well known to those skilled in the art. For example, the latch coupling provided by Sperry-Sun, a division of Halliburton Energy Services, Inc., in conjunction with its LTBS, ITBS and RMLS multilateral well systems includes such a latch profile. It is preferred that the orienting latch profile 16 be interconnected in the casing string 14 when it is cemented in the parent wellbore 12, in order to facilitate later operations in the well, but such is not necessary in keeping with the principles of the invention. For example, the profile 16 could be attached to a packer or liner hanger 18 installed after the casing string 14 is cemented in the parent wellbore 12.

A branch wellbore 20 is drilled extending outwardly from a window 22 formed in the casing string 14. The branch wellbore 20 may be drilled, and the window 22 may be formed, according to conventional practices. For example, a deflector (not shown) may be engaged with the profile 16, and one or more mills, drills or other cutting devices may be deflected laterally off of the deflector to form the window 22 and drill the branch wellbore 20. Preferably, the profile 16 is rotationally oriented so that the window 22 and branch wellbore 20 are formed in a desired direction relative to the parent wellbore 12.

A liner string 24 and a packer or liner hanger 26 are installed in the branch wellbore 20. The liner string 24 may be cemented in the branch wellbore 20, if desired, or it may be left uncemented (as is typically the case in a TAML level 2 completion). As used herein, the terms "liner string", "liner", "lined" and the like are used for convenience to refer to any wellbore linings, such as casing, liner, etc., made of any material, such as steel, other metals, plastic, composites, etc.

Preferably, the packers 18, 26 have PBR's or other seal bores 28, 30, respectively, therein or attached thereto, for purposes that will be described in detail below. Alternatively, seal bores (such as PBR's), could be interconnected in the casing string 14 and/or liner string 24 in place of, or in addition to, the packers 18, 26.

Note that, at this point in the method 10, neither the parent wellbore 12, nor the branch wellbore 20, is isolated from a formation 32 surrounding the intersection of the wellbores. Thus, if it is desired to provide pressure isolation from the formation 32, or to prevent migration of sand, fines, fluids, etc. from the formation into the wellbores 12, 20, a sealed wellbore junction should be installed.

Figure 4:
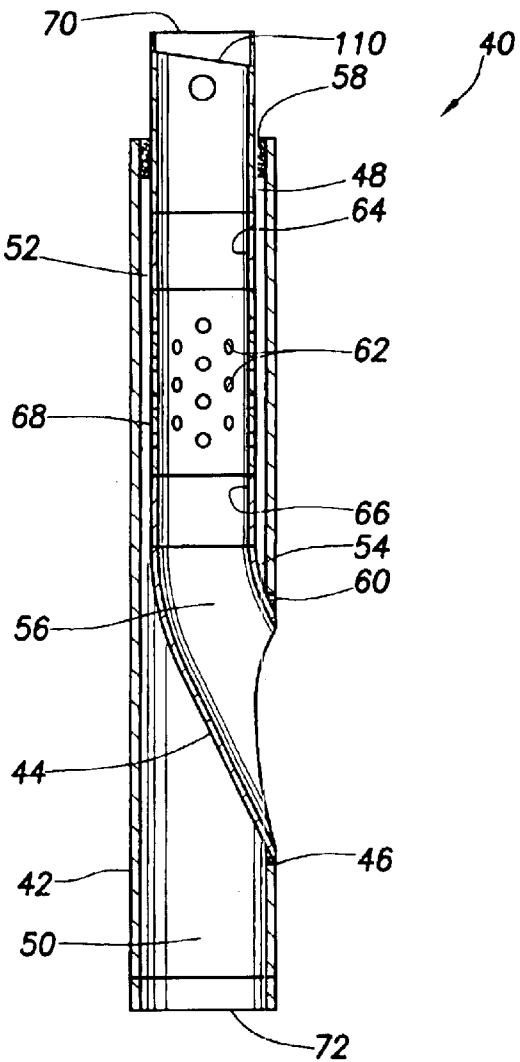
FIG. 4 is cross-sectional view of the completion apparatus, wherein an inner tubular structure has been installed in the outer tubular structure.
Figure 3:
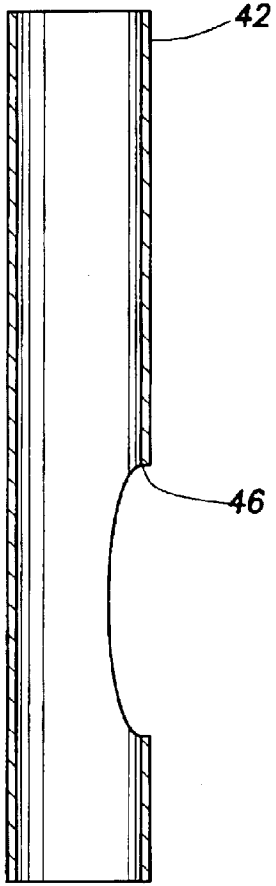
FIG. 3 is a cross-sectional view of the outer tubular structure, taken along line 3—3 of FIG. 2.
Figure 2:
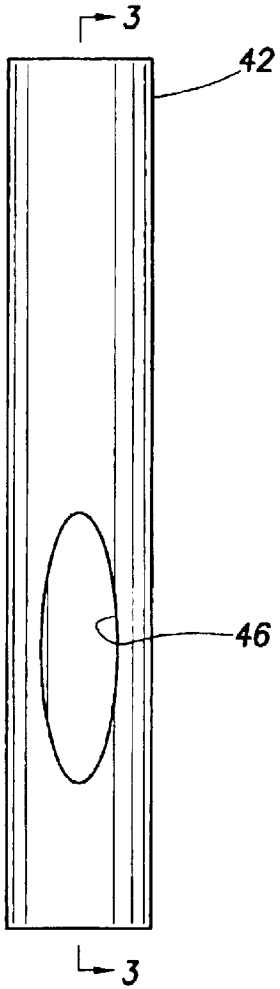
FIG. 2 is a side elevational view of an outer tubular structure of a completion apparatus usable in the method of FIG. 1, the apparatus embodying principles of the invention.

Referring additionally now to FIGS. 2–4, the construction of a completion apparatus 40 embodying principles of the invention, which provides such a sealed wellbore junction, is representatively illustrated. FIGS. 2 & 3 show the construction of an outer tubular structure 42, while FIG. 4 shows an assembly with an inner tubular structure 44 installed in the outer tubular structure.

In FIGS. 2 & 3 it may be seen that the outer structure 42 is generally tubular and has an opening 46 formed through a sidewall thereof. The outer structure 42 is preferably made of a length of casing, since such material is readily available in the oilfield industry and is relatively inexpensive. The outer structure 42 is sized to fit within the casing string 14. For example, if the casing string 14 is 9⅝", then the outer structure 42 may be made of 8⅛" casing.

The opening 46 is sized and positioned in the outer structure 42 to correspond with the window 22 in the casing string 14. In this manner, the opening 46 will provide unrestricted access between the outer structure 42 interior and the window 22 when the apparatus 40 is installed in the parent wellbore 12, as described more fully below.

In FIG. 4 the manner in which the inner structure 44 is installed in the outer structure 42 may be seen. The inner structure 44 is also preferably made of casing material which is readily available and relatively inexpensive. The inner structure 44 is sized to fit within the outer structure 42. For example, if the outer structure 42 is made of 8⅛" casing material, the inner structure 44 may be made of 6" casing material. Of course, the dimensions given herein are only examples, and any type of material may be used for the inner and outer structures, in keeping with the principles of the invention.

An upper portion 48 of the inner structure 44 extends longitudinally and coaxially within a flow passage 50 of the outer structure 42. An annulus 52 is thereby formed between the inner and outer structures 42, 44. This annulus 52 is in fluid communication with the flow passage 50.

A lower portion 54 of the inner structure 44 deviates laterally relative to the outer structure 42, so that a flow passage 56 formed through the inner structure extends outwardly through the opening 46. To construct the apparatus 40 in this manner, the inner structure 44 may initially extend outwardly through the opening a distance, and then be cut off, so that the lower portion 54 is flush with the outer surface of the outer structure 42, as depicted in FIG. 4. However, it should be clearly understood that any manner of constructing the apparatus 40 may be used in keeping with the principles of the invention.

An upper seal 58 seals off the annulus 52 between the inner and outer structures 42, 44. Preferably, the seal 58 is formed by welding the inner and outer structures 42, 44 together, in which case the weld also serves to attach the structures to each other. However, other methods could be used to accomplish these purposes. For example, the inner and outer structures 42, 44 could be threaded together, other types of seals could be used, such as gaskets, o-rings, packing, metal to metal seals, etc.

Another seal 60 seals between the outer structure 42 and the lower portion 54 of the inner structure 44 about the opening 46. Again, the seal 60 is preferably formed by welding the inner and outer structures 42, 44 together, but other methods may be used in keeping with the principles of the invention.

To provide for fluid communication between the flow passages 56, 50 of the inner and outer structures 42, 44, one or more ports 62 are provided through a sidewall of the inner structure. In practice, the ports 62 may be provided by interconnecting a perforated sub 68 in the inner structure 44. Note that the ports 62 are positioned between the seals 58, 60 in the inner structure 44.

Internal seal bores 64, 66 are also interconnected in the inner structure 44. Note that the seal bores 64, 66 straddle the ports 62. The seal bores 64, 66 may be used to provide sealed fluid communication through the ports 62, or to prevent flow through the ports, as described more fully below.

An upper end 70 of the inner structure 44 is configured for connection to a running tool (not shown) of the type well known to those skilled in the art. A lower end 72 is provided with internal threads for connection to an orienting latch 74 (see FIG. 5) to anchor and rotationally orient the apparatus 40 relative to the window 22 in the parent wellbore 12. However, it should be clearly understood that any means of running, installing and rotationally orienting the apparatus 40 may be used in keeping with the principles of the invention. For example, the apparatus 40 could be connected to a tubing string for conveyance into the parent wellbore, a gyroscope could be used to rotationally orient the apparatus, a packer or hanger could be used to anchor the apparatus, etc.

Figure 5:
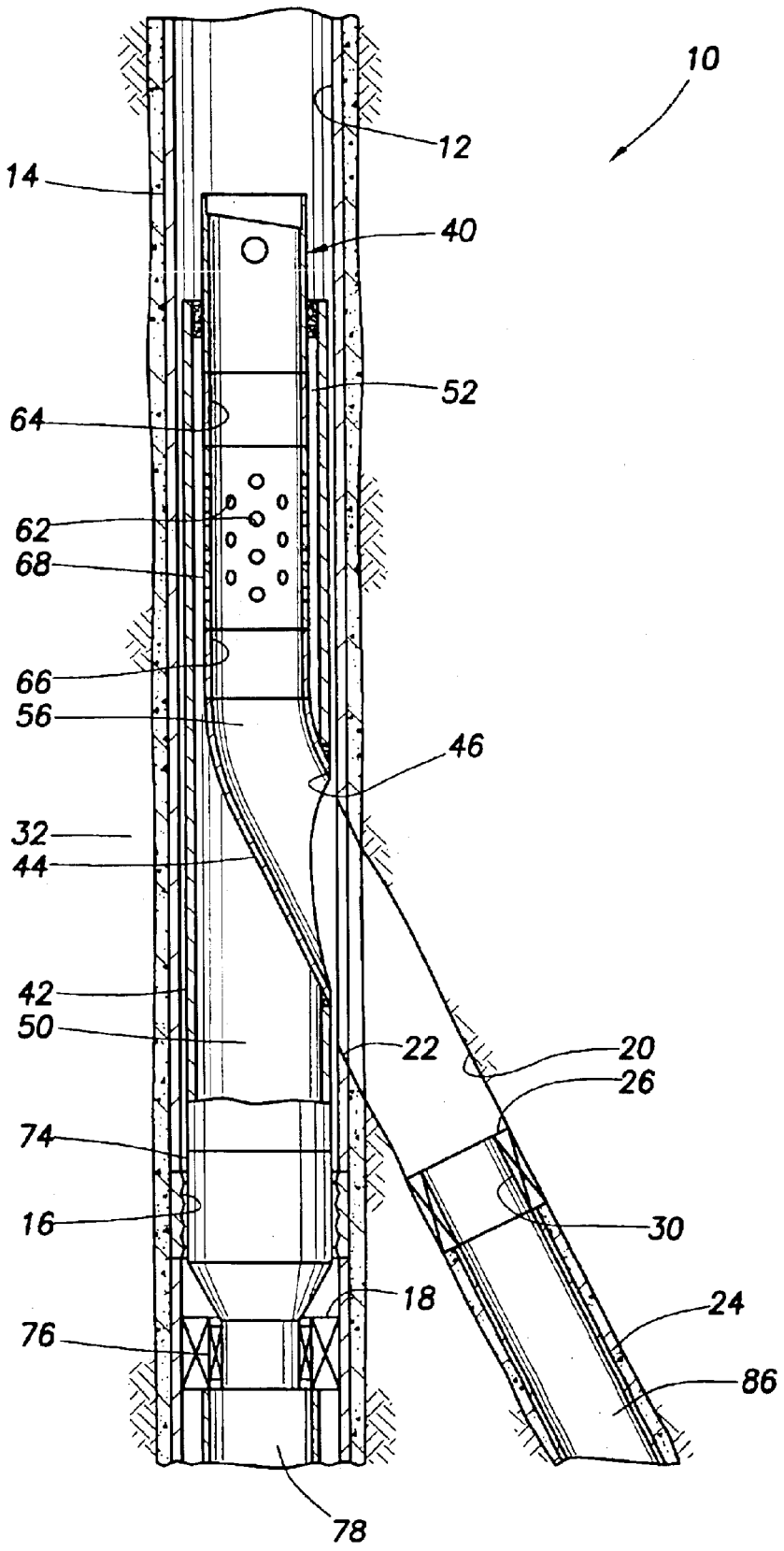
FIG. 5 is a cross-sectional view of the method of FIG. 1, wherein the completion apparatus is being installed in a parent wellbore.

Referring additionally now to FIG. 5, the apparatus 40 is depicted installed and rotationally oriented relative to the window 22 in the parent wellbore 12 in the method 10. The orienting latch 74 attached to the outer structure 42 has engaged the orienting profile 16 to anchor the apparatus 40 in position and rotationally align the opening 46 with the window 22.

Instead of the orienting latch 74 engaging the profile 16, the apparatus 40 could include a self-locating key of the type used in the Sperry-Sun LRS-SL™ system and well known to those skilled in the art. The self-locating key would extend outward from the apparatus 40 into the window 22 and, as the apparatus 40 is lowered in the parent wellbore 12, the key would "find" the lowermost edge of the window, thereby rotationally and axially aligning the opening 46 with the window.

It may now be fully appreciated how the construction of the apparatus 40 provides unhindered access and fluid communication between the parent wellbore 12 and the branch wellbore 20 via the flow passage 56 of the inner structure 44. This result is accomplished very economically and using readily available materials in the construction of the apparatus 40.

A seal stack 76 attached to a lower end of the latch 74 is sealed within the seal bore 28 (see FIG. 1), thereby providing sealed fluid communication between the outer structure flow passage 50 and a flow passage 78 extending in the parent wellbore 12 below the packer 18. In this manner, fluid produced from a zone intersected by the parent wellbore 12 (or another branch of the parent wellbore) below the window 22 may be flowed via the passages 78, 50, the annulus 52, the ports 62, and into the inner structure flow passage 56. This flow direction could be reversed in the case of an injection well, other types of operations, etc. Alternatively, the seal stack 76 could be a cup packer which seals directly in the internal bore of the casing string 14, or in a seal bore (such as a PBR), interconnected in the casing string, in which case the packer 18 may not be needed in the method 10.

Note that at this point in the method 10, the wellbores 12, 20 are still not isolated from the formation 32 surrounding the wellbore intersection. Yet another portion of the apparatus 40 remains to be installed in order to accomplish this objective. However, the apparatus 40 does at this point in the method 10 provide the flow passage 56 through the inner tubular structure 44 which is preferably at least as large as a flow passage 86 extending through the liner string 24 in the branch wellbore 20.

Figure 6:
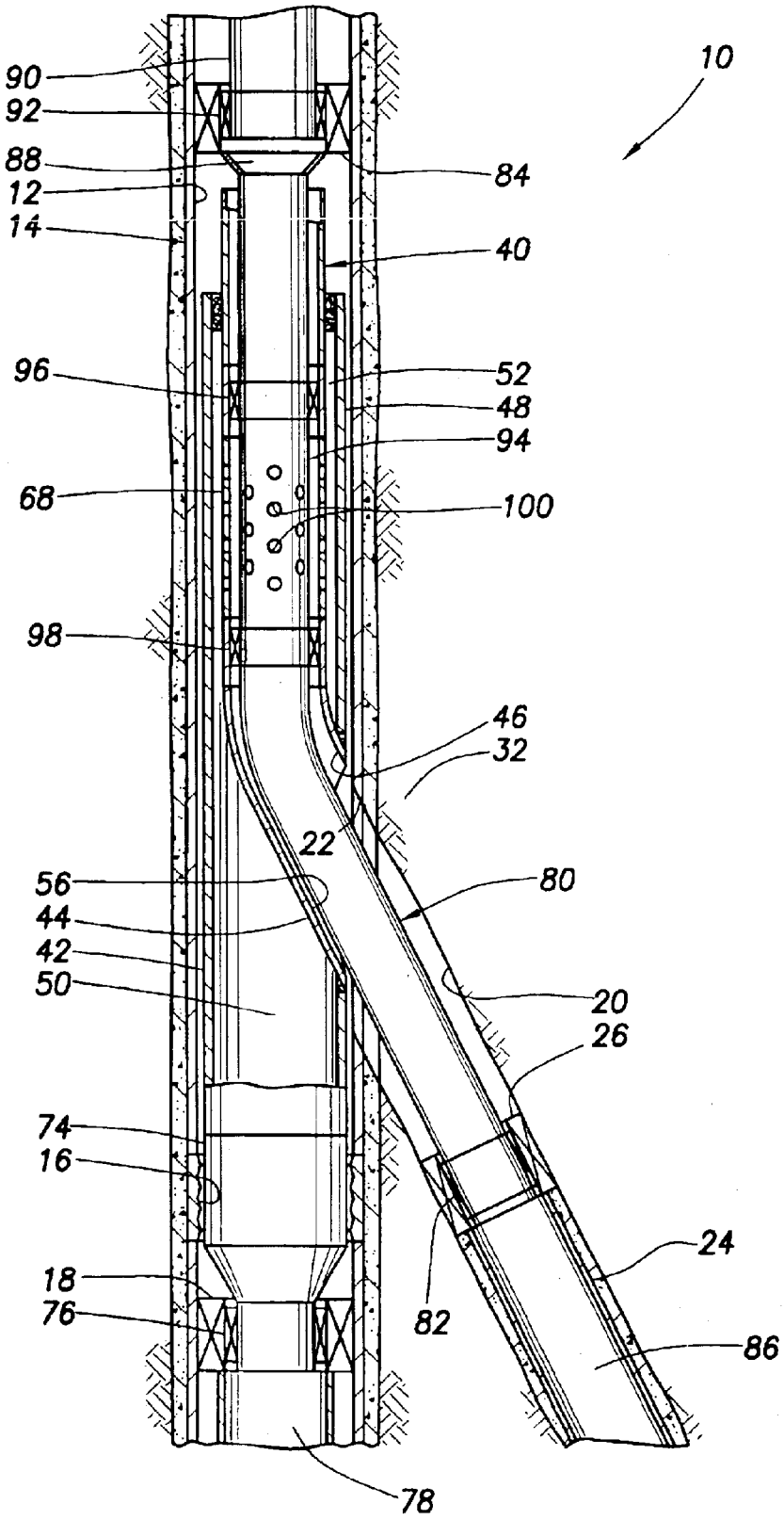
FIG. 6 is a cross-sectional view of the method, wherein a tubular string is being inserted through the inner tubular structure and into a branch wellbore.

Referring additionally now to FIG. 6, the method 10 is depicted with a tubular string 80 inserted through the inner structure flow passage 56, outward through the opening 46, through the window 22, and into the branch wellbore 20. A seal stack 82 carried on a lower end of the tubular string 80 is sealed within the seal bore 30 of the packer 26. Alternatively, the seal stack 82 could be a cup packer which seals directly in the internal bore of the liner string 24, or in a seal bore (such as a PBR) interconnected in the liner string. A packer or liner hanger 84 (preferably, a retrievable packer) at an upper end of the tubular string 80 seals and anchors the tubular string in the casing string 14 in the parent wellbore 12.

Instead of the packer 84, the tubular string 80 could be secured directly to the apparatus 40, for example, by using a RATCH-LATCH™ of the type available from Halliburton Energy Services and well known to those skilled in the art. In that case, the packer 84 could be replaced with another type of seal, such as a cup packer.

It will now be appreciated that the tubular string 80 provides a flowpath from a flow passage 86 in the liner string 24 in the branch wellbore 20 to the interior of the parent wellbore 12 above the inner and outer structures 42, 44, via a flow passage 88 extending through the tubular string. The tubular string 80 may be made up substantially of production tubing, liner, etc., or another material which is preferably readily available and relatively inexpensive.

A tubing string 90 having a seal stack 92 at a lower end thereof is stabbed into a seal bore of the packer 84. The tubing string 90 is used to flow fluids produced from both the parent and branch wellbores 12, 20 to the surface. However, flows from the wellbores 12, 20 could be segregated, if desired, in keeping with the principles of the invention.

Alternatively, the tubing string 90 could be attached directly to the packer 84, instead of being run into the well in a separate trip. Furthermore, the tubular string 80 could be run into the well with the remainder of the apparatus 40 in a single trip into the well. For example, the tubular string 80 could be received within the upper portion 48 of the inner tubular structure 44 and releasably secured thereto using devices such as shear pins, J-slots, collets, dogs, etc. When the apparatus 40 is properly positioned in the parent wellbore 12, with the opening 46 aligned with the window 22, the tubular string 80 could be released (for example, by manipulating the tubing string 90 attached to the packer 84) and displaced through the window 22 into the branch wellbore 20. Thus, the tubing string 90, tubular string 80, and the remainder of the apparatus 40 may be installed in the well in a single trip, if desired.

The tubular string 80 includes a perforated sub 94 interconnected therein. The sub 94 has one or more perforations 100 formed through its sidewall. The perforations 100 permit fluid communication between the tubular string flow passage 88 and the annulus 52 via the ports 62. Thus, fluid in the outer structure flow passage 50 can flow into the annulus 52, inward through the ports 62, inward through the perforations 100, and into the tubular string flow passage 88 for production to the surface through the tubing string 90.

When used in injection wells, such as steam injection wells, or "huff and puff" wells, preferably the perforations 100 and ports 62 are sized so that a rate of flow from the tubular string 80 into the parent wellbore 12 below the apparatus 40 is substantially equal to a rate of fluid flow from the tubular string into the branch wellbore 20 below the tubular string. Of course, the perforations 100 and ports 62 may be sized to provide any desired relationship of the flow rates from (or into) each of the wellbores 12, 20 into (or from) the tubular string 80.

The tubular string 80 further includes external seals 96, 98 straddling the perforated sub 94. As depicted in FIG. 6, the seals 96, 98 are sealed within the seal bores 64, 66, respectively. However, if the seals 96, 98 are, for example, cup packers, the seal bores 64, 66 may not be needed, since the seals could seal directly in the interior bore of the inner tubular structure 44. The seals 96, 98 isolate the fluid flowing through the ports 62 and perforations 100 from the wellbore 12 external to the apparatus 40.

At this point in the method 10, fluid in the passages 50, 86, 88 is isolated from the formation 32 surrounding the wellbore intersection. The apparatus 40 thus provides a sealed wellbore junction for the intersecting wellbores 12, 20. It will be readily appreciated that this result has been accomplished economically and expeditiously by the construction and installation of the apparatus 40.

If access to the branch wellbore 20 is needed, it is available through the strings 80, 90. If larger diameter access is needed, the tubing string 90 may be retrieved and the packer 84 may be unset to permit retrieval of the tubular string 80. In this manner, access will be provided through the inner structure flow passage 56.

If it is desired to provide access to the parent wellbore 12 below the window 22, the inner and outer structures 42, 44 of the apparatus 40 may be retrieved from the parent wellbore 12 after the tubular string 80 is retrieved. Thus, the method 10 provides for convenient retrieval, as well as installation, of the apparatus 40.

If it is desired to produce (or inject) fluids only from (or into) the branch wellbore 20, the sub 94 may be provided without the perforations 100 therein. In this manner, fluid communication between the tubular string flow passage 88 and the annulus 52 will be prevented. If it is desired to produce (or inject) fluids only from (or into) the parent wellbore 12 below the apparatus 40, a plug (not shown) may be installed in the tubular string 80 below the perforations 100, thereby preventing fluid communication with the tubular string and branch wellbore 20 therebelow.

Figure 7:
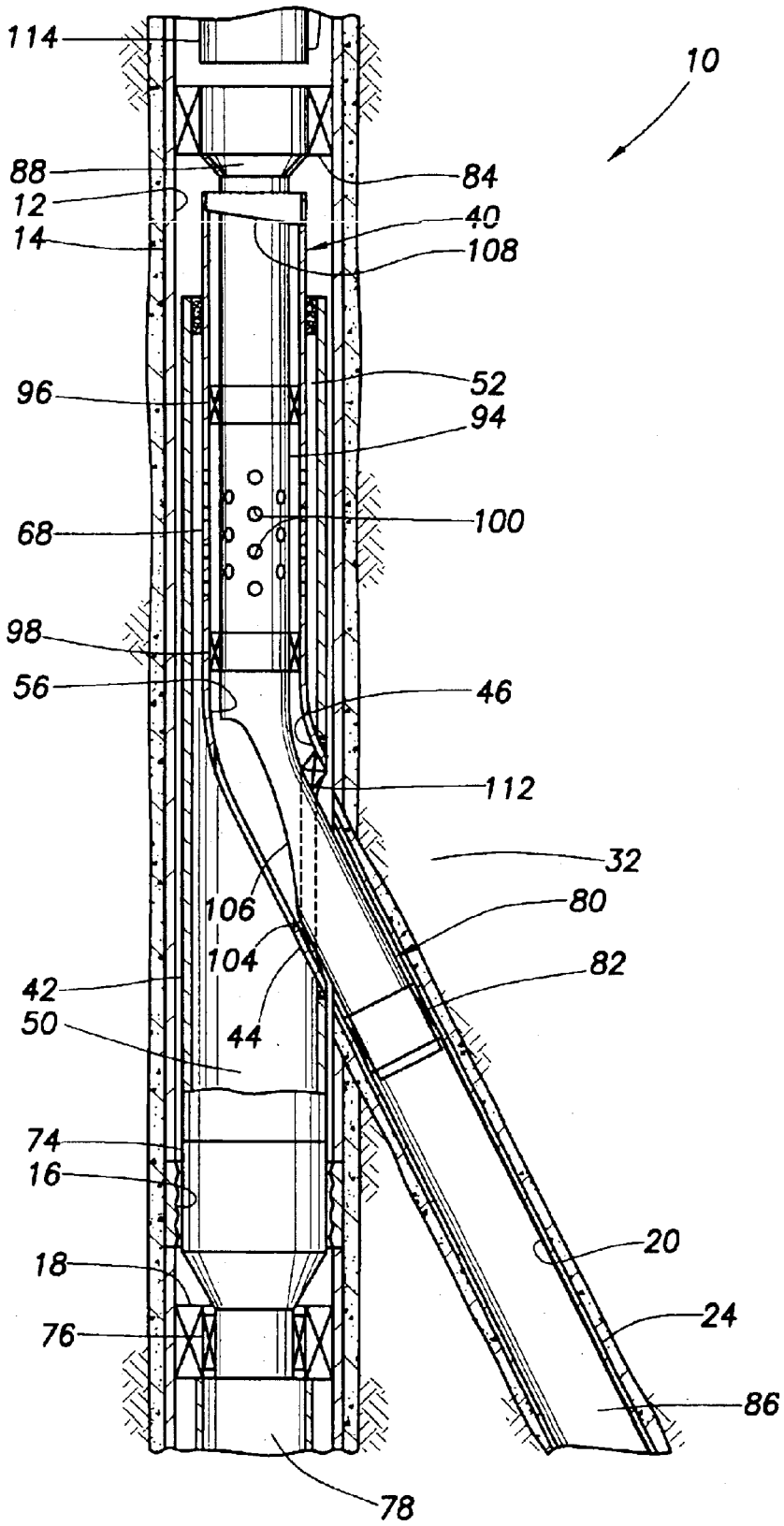
FIG. 7 is a cross-sectional view of the method, showing alternate equipment and alternate steps which may be used in the method.

Referring additionally now to FIG. 7, the method 10 is representatively illustrated, similar to that depicted in FIG. 6, but utilizing alternate steps and equipment. One difference is that the branch wellbore 20 has initially been completed as a TAML level 4 junction, rather than as a TAML level 2 junction as shown in FIG. 1. Note that the liner string 24 extends all the way to the window 22, and is cemented up to the window. It will be appreciated by those skilled in the art that methods and apparatus incorporating principles of the invention permit wells initially completed as TAML levels 2–4 to be converted to TAML level 5. In addition, methods and apparatus incorporating principles of the invention may be used to repair damaged TAML level 6 junctions, such as the Sperry-Sun PACE 6™ junction.

Another difference in the method 10 as shown in FIG. 7 is that the seal 82 is sealingly received in the liner string 20, without use of a distinct seal bore 30 in the liner string. For example, the seal 82 could be a cup packer, or another type of seal, which is capable of sealing within the liner string 20 itself. Any of the seals described herein may be any type of seal, in keeping with the principles of the invention. The description of any particular seal as a packer, cup packer, seal stack, etc., is not to be taken as limiting of the types of seals which may be used.

In the method 10 as depicted in FIG. 7, the distinct seal bores 64, 66 also are not used. The seals 96, 98 are of the type which are capable of sealing between the tubular string 80 and the inner tubular structure 44 without the use of polished bores. For example, the seals 96, 98 could be cup packers, etc.

Yet another difference in FIG. 7 is that an opening 104 is formed through a sidewall of the inner tubular structure 44 in line with the flow passage 50 of the outer tubular structure 42. A corresponding opening 106 is formed through a sidewall of the tubing string 80. The openings 104, 106 are rotationally aligned with each other by means of an inclined shoulder or muleshoe 108 formed on the tubular string 80. As the tubular string 80 is displaced through the inner tubular structure 44, the inclined shoulder 108 engages a corresponding inclined shoulder 110 (see FIG. 4) formed in the upper end of the inner tubular structure, thereby rotationally orienting the tubular string relative to the inner tubular structure and aligning the openings 104, 106.

The openings 104, 106 permit access to the parent wellbore 12 below the apparatus 40, without retrieving the apparatus from the well. A seal 112 circumscribing the tubular string 80 and sealingly engaged between the tubular string and the inner tubular structure 44 isolates the openings 104, 106 from the wellbore intersection external to the apparatus 40. The seal 112 may be carried on the tubular string 80, or it may be carried internally on the inner tubular structure 44.

Note that, if the openings 104, 106 are provided, the perforations 100 and ports 62 are not needed. If the seal 112 is provided, the seal 98 is not needed, as well. However, it may be desired to provide the opening 104 in the inner structure 44, without also providing the opening 106 in the tubular string 80. This would permit access to the parent wellbore 12 below the apparatus 40 when the tubular string 80 is retrieved from the well, while still permitting flow regulation via the perforations 10 and ports 62 when the tubular string is installed in the inner structure 44.

Note that other equipment may be conveyed into the well with the apparatus 40. For example, a remotely adjustable choke or interval control valve, such as the ICV available from Halliburton Energy Services, may be connected to the lower end of the apparatus 40 to control a rate of flow of fluid between the interior of the apparatus and the flow passage 78 below the apparatus. Another remotely controllable flow control device may be connected to the lower end of the tubular string 80 to control a rate of flow of fluid between the tubular string and the flow passage 86 below the tubular string.

In this manner, the openings 104, 106 could be provided for access to the parent wellbore 12 below the apparatus 40, while still permitting accurate flow regulation in both wellbores 12, 20. Any type of additional equipment and/or instrumentation, such as valves, pressure, temperature, flow rate sensors, etc., whether or not remotely controlled, may be added to the apparatus 40, without departing from the principles of the invention.

A further difference depicted in FIG. 7 is that, instead of the tubing string 90 and seal 92 engaged with the packer 84 as depicted in FIG. 6, the method 10 as depicted in FIG. 7 uses a pump, such as an electric subsurface pump 114 attached to the packer 84. The pump 114 would not normally be connected directly to the packer 84 after installation, unless desired. However, the pump 114 may be conveyed into the well with the tubular string 80, attached to the packer 84, in a single trip into the well.

Of course, a person skilled in the art would, upon a careful consideration of the above description of a representative embodiment of the invention, readily appreciate that many modifications, additions, substitutions, deletions, and other changes may be made to this specific embodiment, and such changes are contemplated by the principles of the present invention. Accordingly, the foregoing detailed description is to be clearly understood as being given by way of illustration and example only, the spirit and scope of the present invention being limited solely by the appended claims and their equivalents.

What is claimed is:

1. A multilateral well completion apparatus, comprising:

an outer structure positioned within a casing and having a flow passage, and an opening formed through a sidewall of the outer structure; and an inner structure having a first portion extending longitudinally within the outer structure flow passage, and a second portion extending laterally to the outer structure opening, fluid communication being provided, via a sidewall portion of the first inner structure portion, between an interior portion of the inner structure and an interior portion of the outer structure external to the inner structure.

2. The apparatus according to claim 1, wherein each of the first and second structures is generally tubular shaped.

3. The apparatus according to claim 1, wherein the inner structure extends into the outer structure opening.

4. The apparatus according to claim 1, wherein a flow passage of the inner structure extends through the outer structure opening.

5. The apparatus according to claim 4, wherein the outer structure flow passage is in fluid communication with the inner structure flow passage.

6. The apparatus according to claim 4, wherein an opening formed through a sidewall of the Inner structure provides fluid communication between the outer structure flow passage and the inner structure flow passage.

7. A multilateral well completion apparatus, comprising:

an outer structure having a flow passage, and an opening formed through a sidewall of the outer structure;

an inner structure having a first portion extending longitudinally within the outer structure flow passage, and a second portion extending laterally to the outer structure opening, a flow passage of the inner structure extending through the outer structure opening, fluid communication being provided, via a sidewall portion of the first inner structure portion, between an interior portion of the inner structure and an interior portion of the outer structure external to the inner structure; and a tubular string sealingly received within the inner structure, a flow passage formed through the tubular string being in fluid communication with the outer structure flow passage.

8. A multilateral well completion apparatus, comprising:

an outer structure having a flow passage, and an opening formed through a sidewall of the outer structure;

an inner structure having a first portion extending longitudinally within the outer structure flow passage, and a second portion extending laterally to the outer structure opening, a flow passage of the inner structure extending through the outer structure opening; and a tubular string sealingly received within the inner structure, a flow passage formed through the tubular string being in fluid communication with the outer structure flow passage, fluid communication between the tubular string flow passage and the outer structure flow passage being provided by at least one port formed through a sidewall of the inner structure and at least one perforation formed through a sidewall of the tubular string.

9. The apparatus according to claim 8, further comprising seals sealing between the tubular string and the inner structure on opposite sides of the port and perforation.

10. A multilateral well completion system, comprising:

a parent wellbore lined with a casing string;

a branch wellbore extending outwardly from a window in the casing string; and a completion apparatus positioned within the parent wellbore, the apparatus including inner and outer tubular structures, the outer structure extending in the parent wellbore on opposite sides of the window, the outer structure having an opening in a sidewall thereof aligned with the window, the inner structure extending longitudinally within the outer structure to the outer structure opening, and a longitudinal flow passage formed through the inner structure extending through the outer structure opening, fluid communication being provided, via a sidewall portion of the inner tubular structure, between the interior of the inner tubular structure and an interior portion of the outer tubular structure exterior to the inner tubular structure.

11. The completion system according to claim 10, further comprising an opening formed through a sidewall of the inner structure, the inner structure opening permitting access between opposite sides of the window in the parent wellbore through the apparatus.

12. The completion system according to claim 11, further comprising a tubular string extending through the inner tubular structure, through the window and into the branch wellbore.

13. The completion system according to claim 10, wherein a first seal seals an annulus between the outer tubular structure and a first portion of the inner tubular structure extending longitudinally within the outer tubular structure.

14. The completion system according to claim 13, wherein a second seal seals about the opening between the outer tubular structure and a second portion of the inner tubular structure in which the flow passage is deviated laterally relative to the outer tubular structure toward the opening.

15. A multilateral well completion system, comprising:

a parent wellbore lined with a casing string;

a branch wellbore extending outwardly from a window in the casing string;

a completion apparatus positioned within the parent wellbore, the apparatus including inner and outer tubular structures, the outer structure extending in the parent wellbore on opposite sides of the window, the outer structure having an opening in a sidewall thereof aligned with the window, the inner structure extending longitudinally within the outer structure to the outer structure opening, and a longitudinal flow passage formed through the inner structure extending through the outer structure opening;

an opening formed through a sidewall of the inner structure, the inner structure opening permitting access between opposite sides of the window in the parent wellbore through the apparatus;

a tubular string extending through the inner tubular structure, through the window and into the branch wellbore; and an opening formed through a sidewall of the tubular string, the tubular string opening being aligned with the inner structure opening, thereby permitting access between opposite sides of the window in the parent wellbore through the apparatus.

16. A multilateral well completion system, comprising:

a parent wellbore lined with a casing string;

a branch wellbore extending outwardly from a window in the casing string;

a completion apparatus positioned within the parent wellbore, the apparatus including inner and outer tubular structures, the outer structure extending in the parent wellbore on opposite sides of the window, the outer structure having an opening in a sidewall thereof aligned with the window, the inner structure extending longitudinally within the outer structure to the outer structure opening, and a longitudinal flow passage formed through the inner structure extending through the outer structure opening, a first seal sealing an annulus between the outer tubular structure and a first portion of the inner tubular structure extending longitudinally within the outer tubular structure, and a second seal sealing about the opening between the outer tubular structure and a second portion of the inner tubular structure in which the flow passage Is deviated laterally relative to the outer tubular structure toward the opening; and a port formed through a sidewall of the inner tubular structure between the first and second seals, the port providing fluid communication between the inner tubular structure flow passage and the annulus between the inner and outer tubular members.

17. The completion system according to claim 16, further comprising a tubular string extending through the inner tubular structure, through the window and into the branch wellbore.

18. The completion system according to claim 17, wherein the tubular string is sealed within the inner tubular structure straddling the port.

19. The completion system according to claim 18, further comprising a perforation formed through a sidewall of the tubular string, the perforation providing fluid communication between a longitudinal flow passage formed through the tubular string and the annulus between the inner and outer tubular structures via the port.

20. The completion system according to claim 19, wherein a longitudinal flow passage formed through the outer tubular structure is in fluid communication with the annulus between the inner and outer tubular structures.

21. The completion system according to claim 20, wherein the outer tubular structure is rotationally oriented relative to the window by an orienting latch in the parent wellbore.

22. The completion system according to claim 21, wherein the orienting latch is engaged with an orienting profile interconnected in the casing string.

23. A multilateral well completion apparatus, comprising:

inner and outer tubular structures, a first portion of the inner tubular structure extending longitudinally within the outer tubular structure, thereby forming an annulus therebetween, and a second portion of the inner tubular structure deviating laterally relative to the outer tubular structure, so that a longitudinal flow passage of the inner tubular structure extends outwardly through an opening formed through a sidewall of the outer tubular structure, fluid communication being provided, via a sidewall portion of the inner tubular structure, between the interior of the inner tubular structure and the annulus.

24. The completion apparatus according to claim 23, further comprising an orienting latch attached to the outer tubular structure.

25. A multilateral well completion apparatus, comprising:

inner and outer tubular structures, a first portion of the inner tubular structure extending longitudinally within the outer tubular structure, thereby forming an annulus therebetween, and a second portion of the inner tubular structure deviating laterally relative to the outer tubular structure, so that a longitudinal flow passage of the inner tubular structure extends outwardly through an opening formed through a sidewall of the outer tubular structure, the inner tubular structure including a port which provides fluid communication between the annulus and the inner tubular structure flow passage.

26. The completion apparatus according to claim 25, further comprising first and second seals straddling the port, the first seal sealing the annulus between the inner and outer tubular structures and the second seal sealing between the inner tubular structure second portion and the outer tubular structure about the opening.

27. The completion apparatus according to claim 25, wherein the inner tubular structure includes internal seal bores straddling the port.

28. The completion apparatus according to claim 25, wherein the annulus is in fluid communication with a flow passage formed through the outer tubular structure.

29. The completion apparatus according to claim 28, further comprising a tubular string sealingly received within the inner tubular structure and extending outwardly through the opening.

30. The completion apparatus according to claim 29, wherein the tubular string is sealingly engaged within the inner tubular structure straddling the port.

31. The completion apparatus according to claim 30, wherein the tubular string includes a perforation formed through a sidewall of the tubular string, the perforation providing fluid communication between a longitudinal flow passage formed through the tubular string and the annulus between the inner and outer tubular structures via the port.

32. A method of completing a multilateral well, the method comprising the steps of:

installing a completion apparatus in a parent wellbore having a window formed in casing lining the parent wellbore;

rotationally aligning the completion apparatus relative to the window, thereby aligning an opening in a sidewall of an outer tubular structure of the apparatus with a branch wellbore extending outwardly from the window;

inserting a tubular string through an inner tubular structure of the completion apparatus, the inner tubular structure thereby directing the tubular string to deviate laterally out the opening, through the window, and into the branch wellbore; and providing fluid communication, via a sidewall of the inner tubular structure, between a longitudinal flow passage of the inner tubular structure and an annulus formed between the inner and outer tubular structures.

33. The method according to claim 32, further comprising the step of providing fluid communication between the annulus and a longitudinal flow passage formed through the tubular string.

34. The method according to claim 32, further comprising the step of providing fluid communication between the annulus and a flow passage formed longitudinally through the outer tubular structure.

35. The method according to claim 34, further comprising the step of providing fluid communication between the outer tubular structure flow passage and a flow bore of a completion string in the parent wellbore opposite the window from the inner tubular structure.

36. The method according to claim 32, further comprising the step of sealing the tubular string within the branch wellbore.

37. The method according to claim 32, further comprising the step of sealing the tubular string within the inner tubular structure.

38. The method according to claim 32, further comprising the step of sealing the tubular string within the parent wellbore.

* * * * *